US011235184B1

(12) United States Patent
Caputy et al.

(10) Patent No.: US 11,235,184 B1
(45) Date of Patent: Feb. 1, 2022

(54) INTRANASAL CANNULA APPARATUS FOR FILTERING AIR

(71) Applicants: Gregory Gary Caputy, Honolulu, HI (US); Jordan Jon Carlo Caputy, Honolulu, HI (US)

(72) Inventors: Gregory Gary Caputy, Honolulu, HI (US); Jordan Jon Carlo Caputy, Honolulu, HI (US)

( * ) Notice: Subject to any disclaimer, the term of this patent is extended or adjusted under 35 U.S.C. 154(b) by 115 days.

(21) Appl. No.: 16/798,866

(22) Filed: Feb. 24, 2020

Related U.S. Application Data

(60) Provisional application No. 62/854,501, filed on May 30, 2019.

(51) Int. Cl.
*A62B 23/06* (2006.01)
*A62B 9/06* (2006.01)

(52) U.S. Cl.
CPC ..... *A62B 23/06* (2013.01); *A62B 9/06* (2013.01)

(58) Field of Classification Search
CPC .... A62B 7/00; A62B 7/10; A62B 9/00; A62B 9/06; A62B 23/00; A62B 23/06; A62B 23/02; A62B 23/025; A41D 13/11
See application file for complete search history.

(56) References Cited

U.S. PATENT DOCUMENTS

2003/0209145 A1* 11/2003 Soper ..... A62B 23/06 95/273
2006/0085027 A1* 4/2006 Santin ..... A61M 29/00 606/199
2008/0023007 A1* 1/2008 Dolezal ..... A62B 23/06 128/206.11
2009/0007919 A1* 1/2009 Dolezal ..... A62B 7/10 128/206.11
2010/0147307 A1* 6/2010 Narciso ..... A62B 23/06 128/206.11
2015/0238785 A1* 8/2015 Chuang ..... A62B 23/06 128/202.27
2016/0256715 A1* 9/2016 Chao ..... A62B 23/06
2020/0206547 A1* 7/2020 Hellman ..... A61F 5/08

* cited by examiner

*Primary Examiner* — Colin W Stuart
(74) *Attorney, Agent, or Firm* — Plager Schack LLP; Mark H. Plager; Naomi Mann

(57) ABSTRACT

An intranasal cannula apparatus for use to filter air that enters a nasal cavity of a user is provided. The apparatus includes a pair of elongated bodies coupled together and designed to insert in the nasal cavity of the user. Each elongated body has a front portion, a rear portion, a top portion, a bottom portion and side portions that form an internal cavity therein. Each elongated body has a nasal opening disposed on the bottom portion of the elongated body that aligns with one of the nostrils of the user. A dorsal opening is disposed on the top portion of each elongated body. A pair of filters is disposed within the pair of elongated bodies. The apparatus is designed to permit air from the nostrils of the user to pass entirely through the nasal openings and dorsal openings in the elongated bodies to the nasal cavity of the user.

9 Claims, 4 Drawing Sheets

INTRANASAL CANNULA APPARATUS FOR FILTERING AIR

RELATED APPLICATION

The application claims priority to provisional patent application U.S. Ser. No. 62/854,501 filed on May 30, 2019, the entire contents of which is herein incorporated by reference.

BACKGROUND

The embodiments herein relate generally to air filtration devices for individuals. More specifically, embodiments of the invention are directed to an intranasal cannula apparatus for filtering air.

The inhalation of polluted air is a world-wide problem, especially in large cities and other congested areas. Polluted air may contain viruses, bacteria, odors, pollen, foreign objects and/or other particulates, which can cause many health problems for individuals. To address this problem, individuals in these areas often wear masks over their noses and/or mouths to prevent the inhalation of harmful viruses, bacteria and/or particulates. However, air filtration through these masks is ineffective, inefficient, uncomfortable and/or unsightly.

As such, there is a need in the industry for an intranasal cannula apparatus that addresses the limitations of the prior art, which provides an air filtration device that is effective, discreet comfortable and reusable.

SUMMARY

In certain embodiments of the invention, an intranasal cannula apparatus for use to filter air that enters a nasal cavity of a user is provided. The intranasal cannula is configured to align with a nasopharynx and nostrils of the user in the nasal cavity. The intranasal cannula apparatus captures viruses, bacteria, odors, pollen, foreign objects and other particulates passing therethrough. The intranasal cannula apparatus comprises a pair of elongated bodies coupled together and configured to insert in the nasal cavity of the user, each elongated body in the pair of elongated bodies comprising a housing having a front portion, a rear portion opposite the front portion, a top portion connecting the front and rear portions together, a bottom portion connecting the front and rear portions together, and a pair of side portions connecting the front, rear, top and bottom portions together, the front, rear, top, bottom and pair of side portions forming an internal cavity therein, each elongated body in the pair of elongated bodies comprising a nasal opening disposed on the bottom portion of the elongated body and configured to align with one of the nostrils of the user, and a dorsal opening disposed on the top portion of the elongated body, and a pair of filters disposed within the pair of elongated bodies, each filter in the pair of filters extending through space within the internal cavity of one of the pair of elongated bodies, wherein the intranasal cannula apparatus is configured to permit air from the nostrils of the user to pass entirely through the pair of nasal openings and pair of dorsal openings in the pair of elongated bodies to the nasal cavity of the user, thereby enabling the pair of filters in the pair of elongated bodies to capture the viruses, bacteria, odors, pollen, foreign objects or other particulates in the air.

In one embodiment, each elongated body comprises a posterior opening disposed on the rear portion of the elongated body and is configured to align with the nasopharynx of the user.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
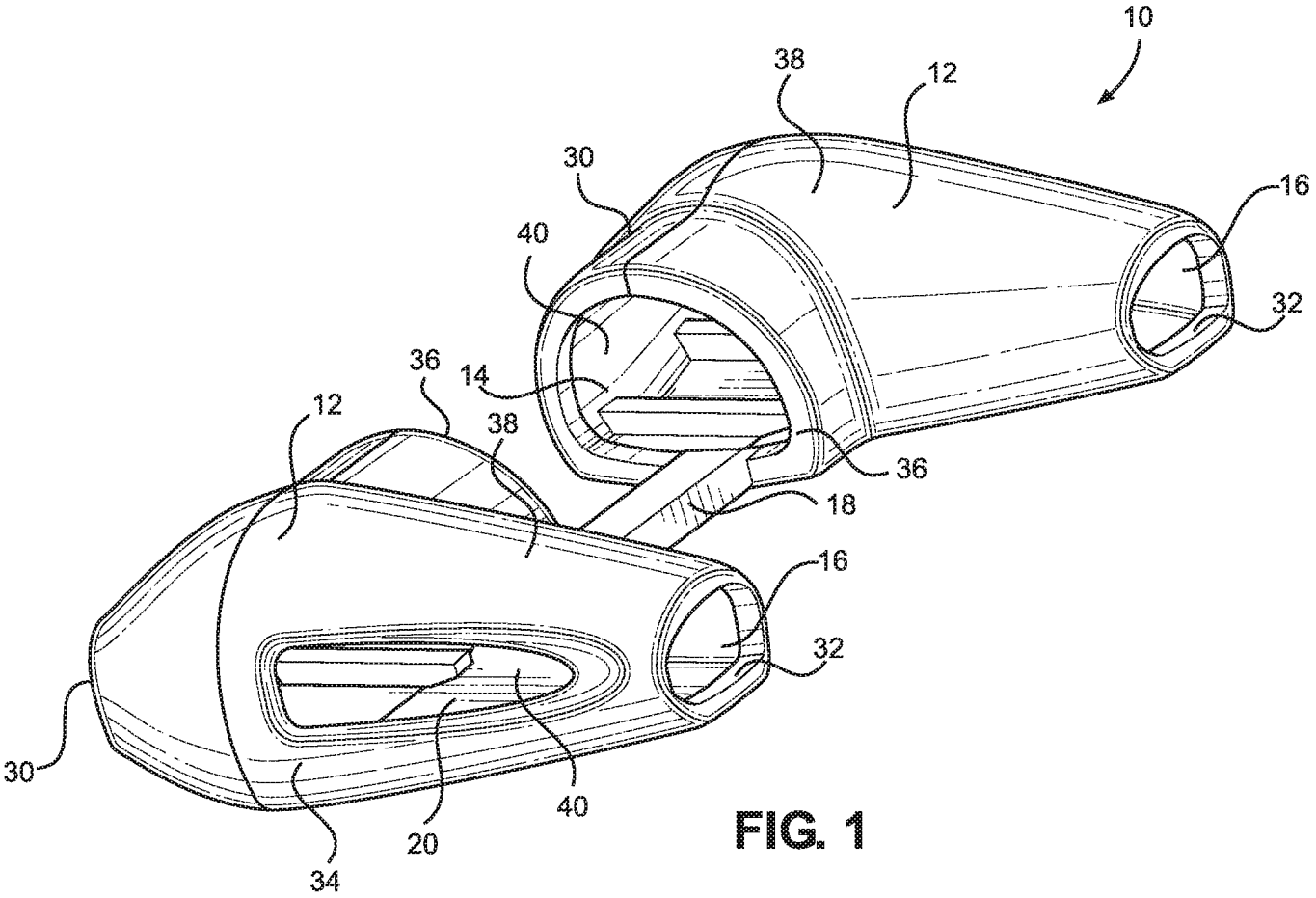
FIG. 1 depicts a perspective view of certain embodiments of the intranasal cannula apparatus.

In certain embodiments as depicted in FIGS. 1 and 4, intranasal cannula apparatus 10 is configured to insert within nose 22 and inside nasal cavity 25 of a user to filter air. More specifically, intranasal cannula apparatus 10 is configured to capture any viruses, bacteria, odors, pollen, foreign objects and/or other particulates in the air passing through the apparatus from nostrils 23 of the user, thereby preventing their entry into nasal cavity 25 of the user. As such, intranasal cannula apparatus 10 effectively filters the incoming air and allows hygienic air to enter nasal cavity 25 of the user.

Figure 2:
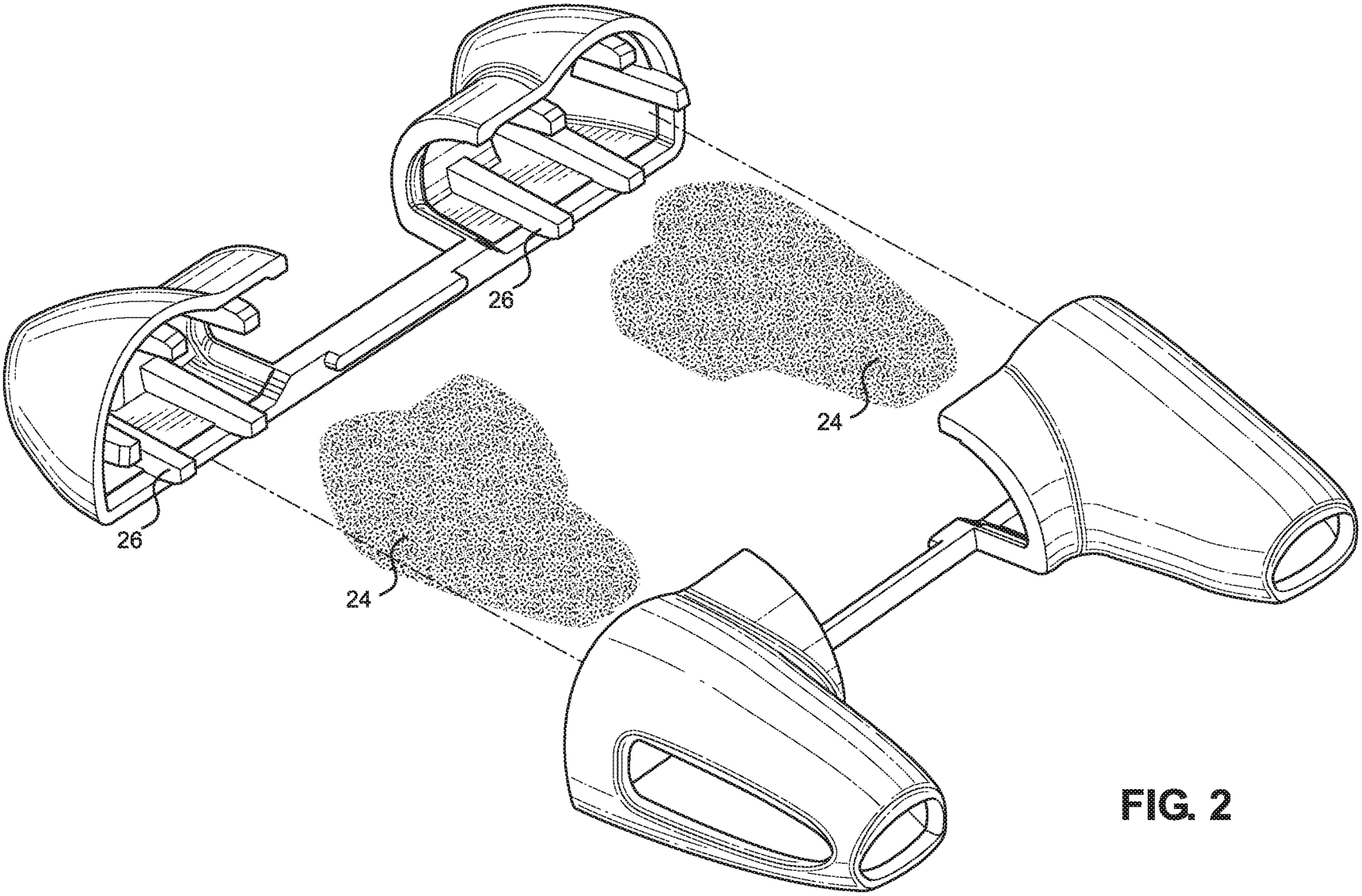
FIG. 2 depicts an exploded view of certain embodiments of the intranasal cannula apparatus.
Figure 3B:
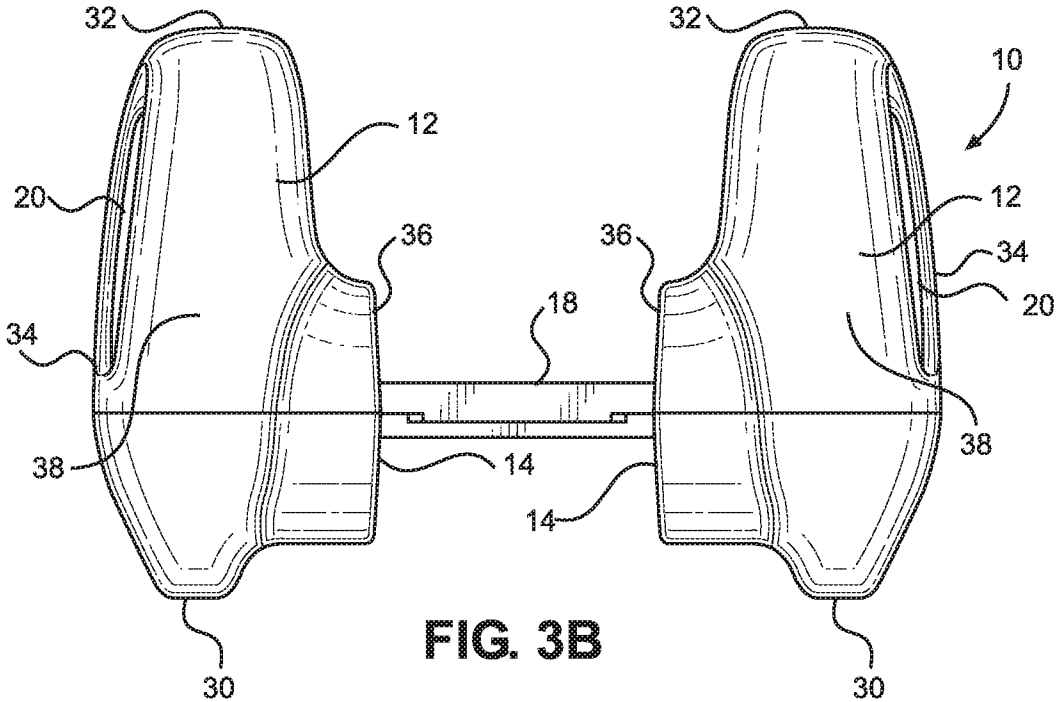
FIG. 3B depicts a top view of certain embodiments of the intranasal cannula apparatus.
Figure 3A:
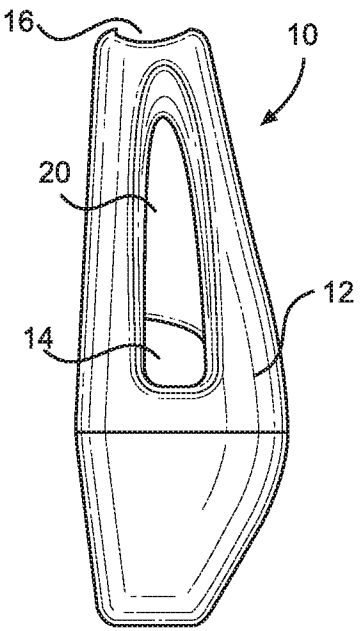
FIG. 3A depicts a side view of certain embodiments of the intranasal cannula apparatus.

In one embodiment as depicted in FIGS. 1-3, intranasal cannula apparatus 10 generally comprises a pair of elongated bodies 12 connected together by strip 18. In a preferred embodiment, elongated bodies 12 and strip 18 of intranasal cannula apparatus 10 are made from silicon, plastic or other similar-type materials. However, the components of intranasal cannula apparatus 10 can be made from any alternative soft, deformable and resilient material that enables the pair of elongated bodies 12 to comfortably fit within nasal cavity 25 of the user.

Figure 3C:
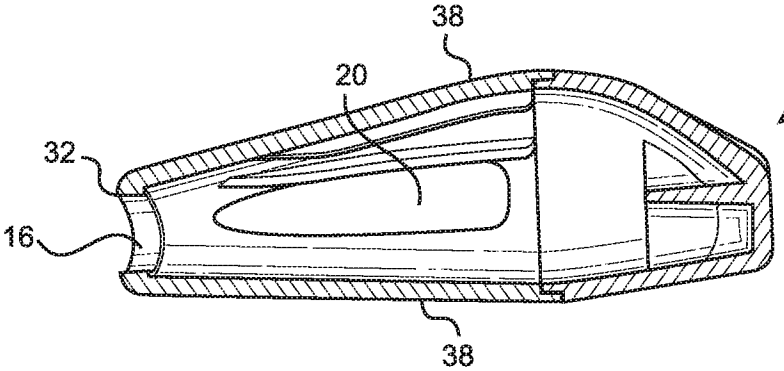
FIG. 3C depicts a cross-sectional view of certain embodiments of the intranasal cannula apparatus.

In one embodiment as depicted in FIGS. 1-3, each elongated body 12 comprises a housing having front portion 30, rear portion 32, top portion 34, bottom portion 36 and a pair of side portions 38 forming internal cavity 40. In one embodiment as depicted in FIG. 3C, elongated body 12 tapers from an intermediate portion of the elongated body to rear portion 32. In one embodiment, elongated body 12 comprises approximate dimensions of a 7 mm width between the pair of side portions 38, and a length of 1.5 cm from front portion 30 to rear portion 32. However, the dimensions of elongated bodies 12 can vary. It shall be appreciated that the shape of elongated bodies 12 can also vary in alternative embodiments.

In one embodiment as depicted in FIG. 2, intranasal cannula apparatus 10 can have a pair or any alternative number of parts that couple together. Alternatively, the components of intranasal cannula apparatus 10 including elongated bodies 12 and strip 18 can be continuously connected together to form a single component. In one embodiment, a plurality of tabs 26 are coupled to the interior of elongated bodies 12 and are configured to enhance the rigidity, strength and durability of intranasal cannula apparatus 10. In one embodiment, the plurality of tabs 26 extend within internal cavity 40 and are oriented generally parallel to a longitudinal axis of elongated body 12.

Elongated body 12 comprises several openings to permit air to enter and exit the apparatus. In one embodiment as depicted in FIGS. 1-3, elongated body 12 comprises nasal opening 14 disposed on bottom portion 36, posterior opening 16 disposed on rear portion 32, and dorsal opening 20 disposed on top portion 34. The size and shape of nasal opening 14, posterior opening 16 and dorsal opening 20 can vary on elongated body 12. It shall be appreciated that the locations of the openings on elongated body 12 can vary in alternative embodiments. Further, any alternative number of openings can be present on elongated bodies 12 in alternative embodiments.

In one embodiment as depicted in FIGS. 1-3, strip 18 comprises opposing ends that connect bottom portions 36 of the pair of elongated bodies 12. Strip 18 preferably has approximate dimensions of a 3 mm-4 mm width and 8 mm-10 mm length. However, strip 18 can have variable dimensions in alternative embodiments. In all embodiments, strip 18 is sufficiently flexible to bend to permit elongated bodies 12 to comfortably insert within nasal cavity 25 of the user.

Figure 4B:
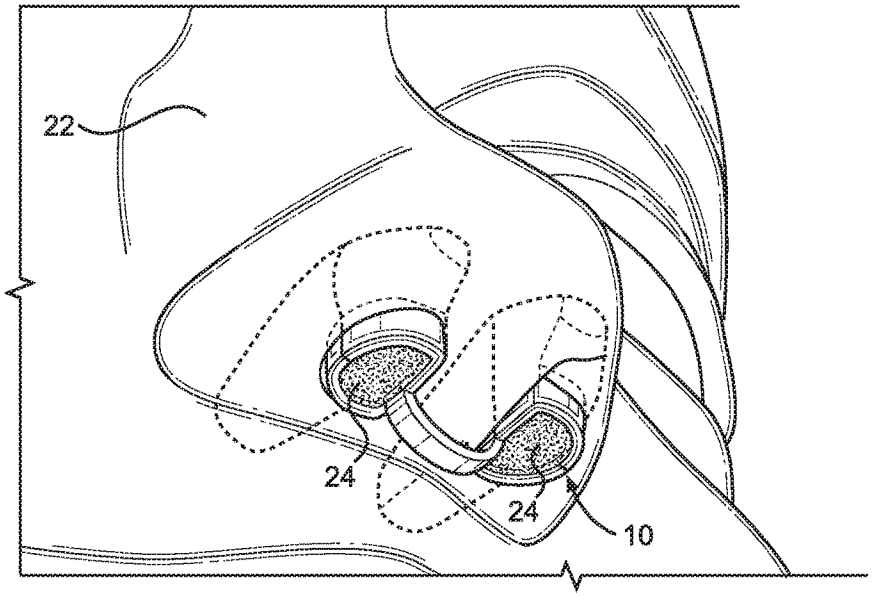
FIG. 4B depicts a perspective view of certain embodiments of the intranasal cannula apparatus shown in use.
Figure 4A:
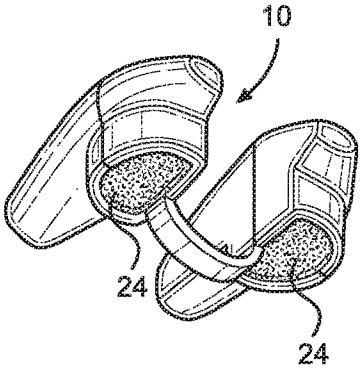
FIG. 4A depicts a bottom perspective view of certain embodiments of the intranasal cannula apparatus.

In one embodiment as depicted in FIGS. 2 and 4A-4B, filter 24 is disposed within each elongated body 12 and is configured to expand to fill the entire space within internal cavity 40 of elongated body 12. In a preferred embodiment, filter 24 is capable of filtering air to HEPA and MERV 15 standards. In one embodiment, filters 24 are biocompatible and non-allergenic filters that accommodate the majority of users. It shall be appreciated that filters 24 can have variable specifications in alternative embodiments as desired.

Figure 4C:
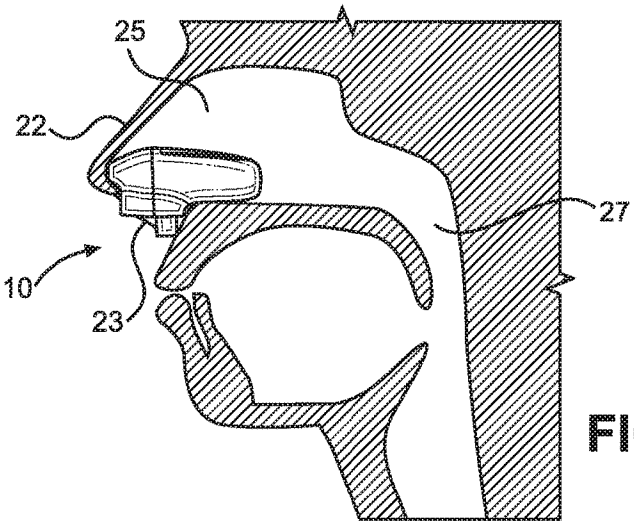
FIG. 4C depicts a cross-sectional view of certain embodiments of the intranasal cannula apparatus shown in use.

In operation as depicted in FIGS. 4B-4C, intranasal cannula apparatus 10 is inserted into nostrils 23 of the user so that the pair of elongated bodies 12 extends within nasal cavity 25 and strip 18 is the only component of the apparatus extending outside of nostrils 23. In this position, the longitudinal axis of each elongated body 12 is oriented generally parallel to the ground when the user is in a standing position. Once properly seated within nasal cavity 25, nasal opening 14 of each elongated body 12 faces downward and is aligned with one of nostrils 23 on nose 22 of the user. Posterior opening 16 of each elongated body 12 is aligned with nasopharynx 27 of the user. Dorsal opening 20 of each elongated body 12 faces upward in nasal cavity 25 of the user.

The user inhales through nostrils 23 to draw air through nasal openings 14 in elongated bodies 12 and out dorsal openings 20 and posterior openings 16 in elongated bodies 12 into nasal cavity 25. As air passes through internal cavity 40 of each elongated body 12, filter 24 present therein captures any viruses, bacteria, odors, pollen, foreign objects and/or other particulates, and prevents their entry into nasal cavity 25 of the user. The user exhales either through the mouth or nose 22. The user repeats the cycles of inhalation and exhalation as needed.

Intranasal cannula apparatus 10 is advantageous because it provides a discreet, reusable and effective device that filters air that enters nasal cavity 25 of the user. As such, intranasal cannula apparatus 10 serves as an inconspicuous device that can be used by the general public, athletes or other individuals of all ages. Intranasal cannula apparatus 10 can be easily attached, removed and reused by the user.

It shall be appreciated that intranasal cannula apparatus 10 can have variable designs. In an alternative embodiment, intranasal cannula apparatus 10 comprises foam disposed around elongated bodies 12. In this embodiment, closed cell foam extends circumferentially or over any alternate portion of nasal opening 14 in each elongated body 12. Open cell foam is disposed around the remaining exposed portion of each elongated body 12. In this embodiment, the closed cell foam forces air entering through nostrils 23 of the user to pass through exposed portions of nasal openings 14 in elongated bodies 12 that are not covered by closed cell foam. The open cell foam surrounding elongated bodies 12 permits air that exits dorsal openings 20 and posterior openings 16 to pass through and enter nasal cavity 25 of the user. By enclosing elongated bodies 12 of intranasal cannula apparatus 10 with foam, it may be possible to simplify the shape of elongated bodies 12 to improve efficiency in the manufacturing process and reduce costs.

It shall be appreciated that the components of the intranasal cannula apparatus described in several embodiments herein may comprise any alternative known materials in the field and be of any color, size and/or dimensions. It shall be appreciated that the components of the intranasal cannula apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. An intranasal cannula apparatus for use to filter air that enters a nasal cavity of a user, the intranasal cannula configured to align with a nasopharynx and nostrils of the user in the nasal cavity, the intranasal cannula apparatus configured to capture viruses, bacteria, odors, pollen, foreign objects and other particulates passing therethrough, the intranasal cannula apparatus comprising:

a pair of elongated bodies coupled together and configured to insert in the nasal cavity of the user, each elongated body in the pair of elongated bodies comprising a housing having a front portion, a rear portion opposite the front portion, a top portion connecting the front and rear portions together, a bottom portion connecting the front and rear portions together, and a pair of side portions connecting the front, rear, top and bottom portions together, the front, rear, top, bottom and pair of side portions forming an internal cavity therein, each elongated body in the pair of elongated bodies comprising a nasal opening disposed on the bottom portion of the elongated body and configured to align with one of the nostrils of the user, and a dorsal opening disposed on the top portion of the elongated body; and a pair of filters disposed within the pair of elongated bodies, each filter in the pair of filters extending through space within the internal cavity of one of the pair of elongated bodies;

wherein the intranasal cannula apparatus is configured to permit air from the nostrils of the user to pass entirely through the pair of nasal openings and pair of dorsal openings in the pair of elongated bodies to the nasal cavity of the user, thereby enabling the pair of filters in the pair of elongated bodies to capture the viruses, bacteria, odors, pollen, foreign objects or other particulates in the air, wherein a longitudinal axis of each of the pair of elongated bodies does not intersect the respective nasal opening of the respective elongated body.

2. The intranasal cannula apparatus of claim 1, wherein each elongated body in the pair of elongated bodies comprises a posterior opening disposed on the rear portion of the elongated body and configured to align with the nasopharynx of the user, wherein the intranasal cannula apparatus is configured to permit the air from the nostrils of the user to pass entirely through the pair of nasal openings and pair of posterior openings in the pair of elongated bodies to the nasal cavity of the user.

3. The intranasal cannula apparatus of claim 2, further comprising a strip comprising a first end coupled to the bottom portion of a first elongated body in the pair of elongated bodies and a second end coupled to the bottom portion of a second elongated body in the pair of elongated bodies.

4. The intranasal cannula apparatus of claim 3, wherein each elongated body in the pair of elongated bodies tapers from an intermediate portion of the elongated body to the rear portion of the elongated body.

5. The intranasal cannula apparatus of claim 4, further comprising a plurality of tabs coupled to each elongated body in the pair of elongated bodies, the plurality of tabs extending in the internal cavity of the elongated body parallel to a longitudinal axis of the elongated body.

6. The intranasal cannula apparatus of claim 4, wherein each filter in the pair of filters is configured to filter the air according to HEPA (High Efficiency Particulate Air) and MERV (Minimum Efficiency Reporting Values) 15 standards.

7. The intranasal cannula apparatus of claim 2, wherein each posterior opening in the pair of posterior openings is on an end of the respective elongated body opposite a closed front end of the elongated body.

8. The intranasal cannula apparatus of claim 1, wherein each of said pair of filters disposed within the pair of elongated bodies fills the entire space within the internal cavity of the respective elongated body.

9. The intranasal cannula apparatus of claim 1, wherein the dorsal opening in each one of the pair of elongated bodies, has a longitudinal axis which is aligned with a longitudinal axis of the elongated body.

* * * * *